US007574160B2

(12) United States Patent
Jung et al.

(10) Patent No.: US 7,574,160 B2
(45) Date of Patent: Aug. 11, 2009

(54) DEVELOPER FILLING APPARATUS AND DEVELOPER FILLING SYSTEM HAVING THE SAME

(75) Inventors: Soo-yong Jung, Suwon-si (KR); Duk-young Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 460 days.

(21) Appl. No.: 11/475,100

(22) Filed: Jun. 27, 2006

(65) Prior Publication Data

US 2007/0003325 A1 Jan. 4, 2007

(30) Foreign Application Priority Data

Jun. 29, 2005 (KR) ..... 10-2005-0057250

(51) Int. Cl.
*G03G 15/00* (2006.01)

(52) U.S. Cl. ..... 399/258; 222/DIG. 1; 399/262

(58) Field of Classification Search ..... 222/4, 222/325, 373, 378, 380, 399, 402.1, 402.25, 222/635, DIG. 1; 399/258, 260, 262, 263
See application file for complete search history.

(56) References Cited

U.S. PATENT DOCUMENTS

| | | | | |
|---|---|---|---|---|
| 5,481,344 | A * | 1/1996 | Yasuda et al. | 399/120 |
| 5,491,542 | A | 2/1996 | Nagashima et al. | |
| 5,655,180 | A * | 8/1997 | Yasuda et al. | 399/106 |
| 6,032,010 | A * | 2/2000 | Kim et al. | 399/238 |
| 6,201,941 | B1 * | 3/2001 | Kasahara et al. | 399/258 |
| 6,628,908 | B2 * | 9/2003 | Matsumoto et al. | 399/106 |
| 7,283,772 | B2 * | 10/2007 | Amano et al. | 399/258 |
| 7,412,191 | B2 * | 8/2008 | Sudo et al. | 399/258 |
| 2004/0197121 | A1 | 10/2004 | Muramatsu et al. | |
| 2006/0024101 | A1 * | 2/2006 | Schoch et al. | 399/358 |

FOREIGN PATENT DOCUMENTS

| | | |
|---|---|---|
| CN | 1107587 | 5/1995 |
| JP | 04174478 A * | 6/1992 |

(Continued)

OTHER PUBLICATIONS

Chinese Office Action issued in Chinese Patent Application No. 200610107686.X on May 9, 2008.

(Continued)

*Primary Examiner*—Robert Beatty
(74) *Attorney, Agent, or Firm*—Stein McEwen, LLP

(57) ABSTRACT

A developer filling apparatus includes a developer supply container for containing a developer and compressed air, the developer supply container includes a developer discharge mechanism, the developer discharge mechanism including a developer outlet opening for discharging the developer and compressed air, and a valve structure disposed at the developer outlet opening for normally closing the developer outlet opening and for opening the developer outlet opening upon application of an external force. Accordingly, because a developer cartridge can be easily filled with a developer using the force of compressed air in a developer filling operation, the developer filling operation can be performed more easily in comparison to a conventional manual one utilizing a developer measuring container. In addition, the developer is prevented from being blown around during the developer filling operation, thereby improving working conditions and avoiding environmental pollution.

47 Claims, 4 Drawing Sheets

FOREIGN PATENT DOCUMENTS

| | | | |
|---|---|---|---|
| JP | 07-333964 | | 12/1995 |
| JP | 2003-057933 | | 2/2003 |
| JP | 2003-208003 | | 7/2003 |
| KR | 2004-100731 | A | 12/2004 |

OTHER PUBLICATIONS

Office Action issued by Chinese Intellectual Property Office in Chinese Patent Application No. 200610107686X on Jun. 5, 2009.

* cited by examiner

DEVELOPER FILLING APPARATUS AND DEVELOPER FILLING SYSTEM HAVING THE SAME

CROSS-REFERENCE TO RELATED APPLICATION

This application claims the benefit under 35 U.S.C. § 119 (a) of Korean Patent Application No. 2005-57250, filed on Jun. 29, 2005, in the Korean Intellectual Property Office, the disclosure of which is incorporated herein by reference.

BACKGROUND OF THE INVENTION

1. Field of the Invention

Aspects of the present invention relate to a developer filling apparatus for an image forming apparatus such as a copier and laser beam printer. More particularly, aspects of the present invention relate to a developer filling apparatus and a developer filling system having the same which enable a developer cartridge mountable in a development unit of an image forming apparatus to be filled with a developer.

2. Description of the Related Art

Generally, an image forming apparatus (such as a copier or laser printer) produces a desired image by forming an electrostatic latent image on a photosensitive body (such as a photosensitive drum or photosensitive belt), developing the formed electrostatic latent image into a developer image using a developer (such as powder toner) in a development unit, and transferring the developer image onto an image receiving medium (such as paper). A typical image forming apparatus includes a developer cartridge for supplying the developer to the development unit. The developer cartridge is configured to be installed in the development unit and supply the developer a little bit at a time to the development unit until the developer in the developer cartridge becomes exhausted. Such a developer cartridge is typically a consumable item and is thrown away after developer exhaustion or is refilled with fresh developer for reuse. Refilling may be carried out, for example, by a specialized recycling company.

Conventionally, a developer measuring container or vessel is typically used when a developer cartridge is refilled with fresh developer. This conventional developer filling process is performed through cumbersome and difficult manual work. In addition, developer powder may be blown around during the developer filling process, resulting in poor working conditions and environmental pollution.

SUMMARY OF THE INVENTION

An aspect of the present invention is to provide a developer filling apparatus and a developer filling system having the same, which permit easy filling of a developer and prevent the developer from being blown around to thereby improve working conditions and avoid environmental pollution.

Additional aspects and/or advantages of the invention will be set forth in part in the description which follows and, in part, will be obvious from the description, or may be learned by practice of the invention.

According to one embodiment, there is provided a developer filling apparatus, including a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position and that opens the developer outlet opening upon application of an external force.

According to an aspect of the invention, the valve structure comprises a first valve placed on a first valve seat portion formed at the developer outlet opening in the developer supply container, the first valve having a first pressing protrusion projecting through the developer outlet opening to the outside of the developer supply container; a first valve rod connected with the first valve and movably installed in the developer supply container; and a first spring installed at the first valve rod, the first spring pushing the first valve towards the developer outlet opening.

According to an aspect of the invention, the developer supply container may further include a first shutter opener that opens a first shutter disposed at a developer inlet opening of a developer cartridge, the first shutter serving to open and close the developer inlet opening. The first shutter opener has a first shutter opening protrusion projecting from the developer outlet opening so as to face the first shutter, the first shutter opening protrusion opening the first shutter.

Further, according to an aspect of the invention, the developer supply container may further include a second shutter opener that opens a second shutter, the second shutter opening and closing a first air discharge opening of a developer cartridge. The second shutter opener has a second shutter opening protrusion projecting so as to face the second shutter, the second shutter opening protrusion opening the second shutter. In this case, it is preferable that the developer supply container further comprises an air discharge mechanism that guides and externally discharges the compressed air coming through the first air discharge opening of the developer cartridge. The air discharge mechanism comprises an air passage including an air inlet opening adapted to face the first air discharge opening and a second air discharge opening adapted to lead to the outside, the air passage guiding the compressed air inhaled through the air inlet opening; and a filter for filtering the developer contained in the compressed air inhaled to the air passage.

Further, according to an aspect of the invention, the developer filling apparatus may further include a developer supply mechanism for supplying the developer to the developer supply container; a compressed air supply mechanism for supplying the compressed air to the developer supply container; and an agitating mechanism for agitating the developer in the developer supply container.

According to an aspect of the invention, the developer supply mechanism may comprise a developer supply opening formed at the developer supply container and a sealing cap that tightly seals the developer supply opening.

According to an aspect of the invention, the compressed air supply mechanism comprises a compressed air supplier that stores or generates compressed air; and a connection pipe for interconnecting the compressed air supplier and the developer supply container. Alternatively, the compressed air supply mechanism may further have a connection fitting that detachably interconnects the connection pipe and the developer supply container.

According to an aspect of the invention, the agitating mechanism comprises an agitation impeller installed in the middle of the developer supply container, the agitation impeller agitating the developer in the developer supply container; and a drive motor coupled to a shaft of the agitation impeller, the drive motor rotating the shaft of the agitation impeller.

In accordance with another embodiment of the present invention, the developer filling system includes a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position and that opens the developer outlet opening upon application of an external force; and a developer cartridge that supplies the developer to a development unit of an image forming apparatus, the developer cartridge comprising a developer inlet mechanism, the developer inlet mechanism including a developer inlet opening that takes in the developer and compressed air discharged through the developer outlet opening, a first open-close section that opens and closes the developer inlet opening, and an opening section disposed at the developer inlet opening to open the developer outlet opening by applying the force to the valve structure.

According to an aspect of the invention, the valve structure comprises a first valve placed on a first valve seat portion formed at the developer outlet opening in the developer supply container, the first valve having a first pressing protrusion projecting through the developer outlet opening to the outside of the developer supply container; a first valve rod connected with the first valve and movably installed in the developer supply container; and a first spring installed at the first valve rod, the first spring pushing the first valve towards the developer outlet opening.

According to an aspect of the invention, the first open-close section has a first shutter that elastically opens and closes the developer inlet opening and a first fastener that locks the first shutter in a closed state. The first fastener can comprise a first fixing screw that fixes the first shutter to the developer cartridge. The developer supply container may further have a first shutter opener that opens the first shutter. The first shutter opener comprises a first shutter opening protrusion projecting from the developer outlet opening so as to face the first shutter, the first shutter opening protrusion opening the first shutter.

Further, according to an aspect of the invention, the developer cartridge may further include a first air discharge mechanism that discharges the compressed air inhaled in the developer cartridge. The first air discharge mechanism comprises a first air discharge opening that discharges the compressed air; a second open-close section that opens and closes the first air discharge opening; and a first filter arranged at the first air discharge opening, the first filter filtering the developer contained in the compressed air discharged through the first air discharge opening. The second open-close section can comprise a second shutter that elastically opens and closes the first air discharge opening and a second fastener that locks the second shutter in a closed state. The second fastener can comprise a second fixing screw that fixes the second shutter to the developer cartridge.

According to an aspect of the invention, the developer supply container further comprises a second shutter opener that opens the second shutter. The second shutter opener comprises a second shutter opening protrusion projecting so as to face the second shutter, the second shutter opening protrusion opening the second shutter. In this case, the developer supply container may further comprise a second air discharge mechanism that guides and externally discharges the compressed air coming through the first air discharge opening. The second air discharge mechanism comprises an air passage including a first air inlet opening adapted to face the first air discharge opening and a second air discharge opening adapted to lead to the outside, the air passage guiding the compressed air inhaled through the first air inlet opening; and a second filter for filtering the developer contained in the compressed air inhaled to the air passage.

Further, according to an aspect of the invention, the developer filling system may further include a developer supply mechanism that supplies the developer to the developer supply container; a compressed air supply mechanism that supplies the compressed air to the developer supply container; and an agitating mechanism that agitates the developer in the developer supply container.

According to an aspect of the invention, the developer supply mechanism comprises a developer supply opening formed at the developer supply container and a sealing cap that tightly seals the developer supply opening.

According to an aspect of the invention, the compressed air supply mechanism comprises a compressed air supplier that stores or generates the compressed air; and a connection pipe that interconnects the compressed air supplier and the developer supply container. Alternatively, the compressed air supply mechanism may further have a connection fitting that detachably interconnects the connection pipe and the developer supply container.

According to an aspect of the invention, the agitating mechanism comprises an agitation impeller installed in the middle of the developer supply container, the agitation impeller agitating the developer in the developer supply container; and a drive motor coupled to a shaft of the agitation impeller, the drive motor rotating the shaft of the agitation impeller.

In accordance with another embodiment of the present invention, a refillable developer cartridge that supplies a developer to a development unit of an image forming apparatus comprises a developer inlet mechanism, the developer inlet mechanism including a developer inlet opening that takes in the developer and compressed air discharged through a developer outlet opening of a developer supply container, a first open-close section that opens and closes the developer inlet opening, and an opening section disposed at the developer inlet opening to open the developer outlet opening of a developer supply container by applying the force to a valve structure of the developer supply container; and an air discharge mechanism that discharges compressed air taken into the developer cartridge, the air discharge mechanism comprising an air discharge opening that discharges compressed air taken into the developer cartridge, a second open-close section that opens and closes the air discharge opening, and a filter arranged at the air discharge opening, the filter filtering any developer contained in the compressed air discharged through the air discharge opening.

In accordance with another aspect of the invention, a developer filling system comprises a developer supply container that contains a developer, the developer supply container comprising a developer discharge mechanism that includes a developer outlet opening that discharges the developer from the developer supply container; and a developer cartridge that supplies the developer to a development unit of an image forming apparatus, the developer cartridge comprising a developer inlet mechanism that includes a developer inlet opening that takes in the developer discharged through the developer outlet opening of the developer supply container, and wherein the developer is discharged from the developer supply container and taken into the developer cartridge according to a pressure differential between the developer supply container and the developer cartridge.

In accordance with another embodiment of the present invention, a refillable developer cartridge that supplies a developer to a development unit of an image forming apparatus comprises a developer inlet mechanism, the developer inlet mechanism including a developer inlet opening that takes in developer and compressed air, a first open-close section that opens and closes the developer inlet opening; and an air discharge mechanism that discharges compressed air taken into the developer cartridge, the air discharge mechanism comprising an air discharge opening that discharges compressed air taken into the developer cartridge, a second open-close section that opens and closes the air discharge opening, and a filter arranged at the air discharge opening, the filter filtering any developer contained in the compressed air discharged through the air discharge opening, wherein the developer cartridge interfaces with a developer filling apparatus comprising a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position absent an external force and that opens the developer outlet opening upon application of an external force, and wherein the first open-close section that opens and closes the developer inlet opening is opened by a first shutter opening protrusion of the developer supply container, the second open-close section that opens and closes the air discharge opening is opened by a second shutter opening protrusion of the developer supply container, and the developer inlet mechanism includes opening protrusion extending from the developer inlet opening that opens the developer outlet opening of the developer supply container by applying the force to the valve structure of the developer supply container.

In accordance with another embodiment of the invention, a method of refilling a developer cartridge comprises engaging (a) the developer cartridge, wherein the developer cartridge comprises a developer inlet mechanism that includes a closeable developer inlet opening that takes in developer into a chamber having a first pressure, with (b) a developer filling apparatus comprising a developer supply container that contains a developer stored at a second pressure greater than the first pressure and comprises a developer discharge mechanism that includes a developer outlet opening that discharges the developer into the chamber of the developer cartridge through a valve structure that opens the developer outlet opening upon application of an external force when the developer filling apparatus is engaged with the developer cartridge; and filling the chamber of the developer cartridge with developer through the opened developer outlet opening of the developer supply chamber and the developer inlet opening according to a pressure differential between first and second pressures.

In accordance with another embodiment of the present invention, a method of refilling a developer cartridge comprises engaging (a) the developer cartridge, wherein the developer cartridge comprises a developer inlet mechanism, the developer inlet mechanism including a developer inlet opening that takes in developer and compressed air, a first shutter that opens and closes the developer inlet opening; and an air discharge mechanism that discharges compressed air taken into the developer cartridge, the air discharge mechanism comprising an air discharge opening that discharges compressed air taken into the developer cartridge, a second shutter that opens and closes the air discharge opening, and a filter arranged at the air discharge opening, the filter filtering any developer contained in the compressed air discharged through the air discharge opening, with (b) a developer filling apparatus comprising a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position absent an external force and that opens the developer outlet opening upon application of an external force, wherein the first shutter of the developer cartridge is opened by a first shutter opening protrusion of the developer supply container, wherein the developer inlet mechanism of the developer cartridge includes an opening protrusion extending from the developer inlet opening that opens the developer outlet opening of the developer supply container by applying the force to the valve structure of the developer supply container so that developer and compressed air enter the developer inlet opening of the developer cartridge, and wherein the second shutter of the developer cartridge is opened by a second shutter opening protrusion of the developer supply container, so that compressed air is discharged through the air discharge opening.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
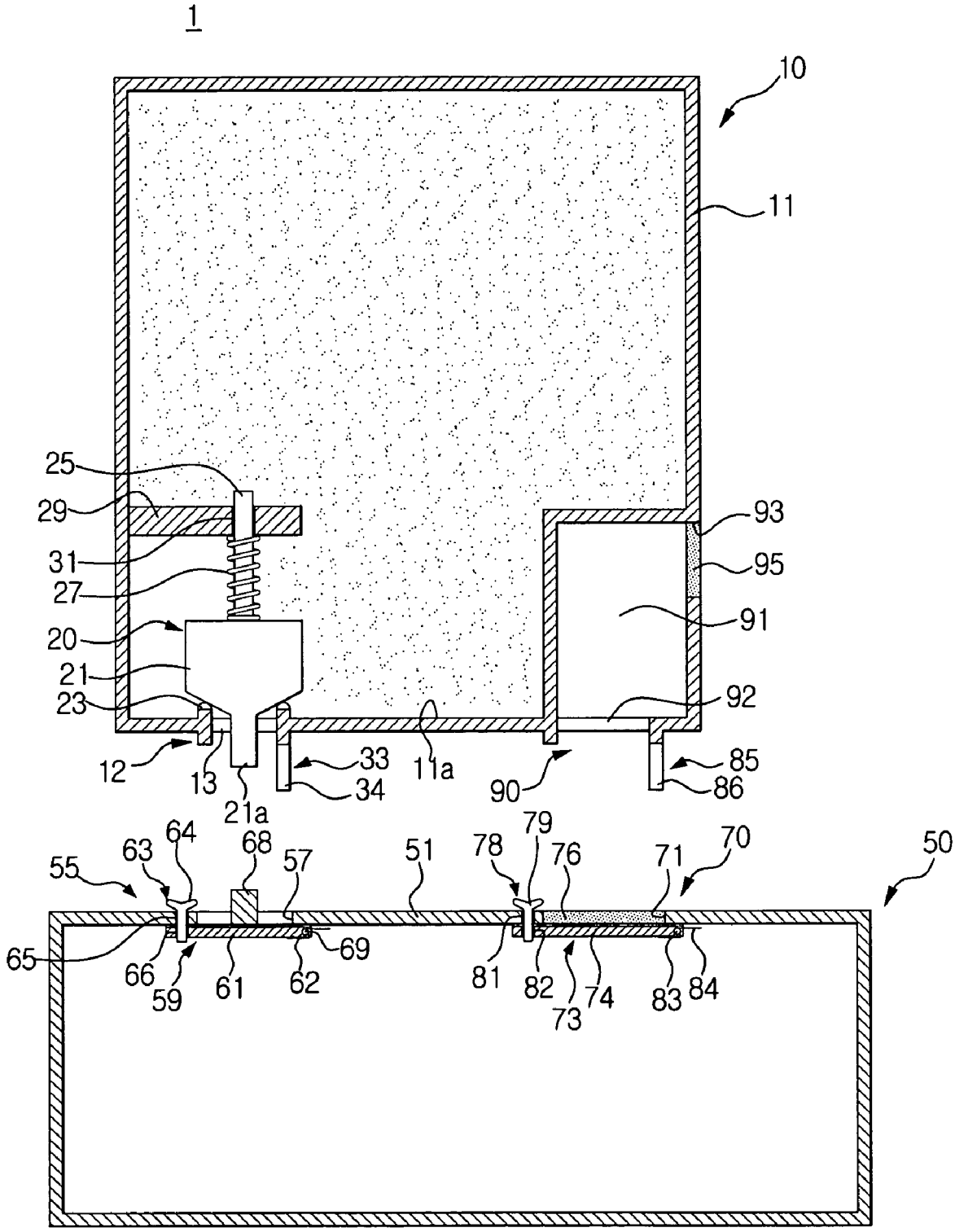
FIG. 1 is a diagram showing a developer filling system according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the FIGS. Well-known functions or constructions are not described in detail since they would obscure the invention in unnecessary detail.

Figure 2:
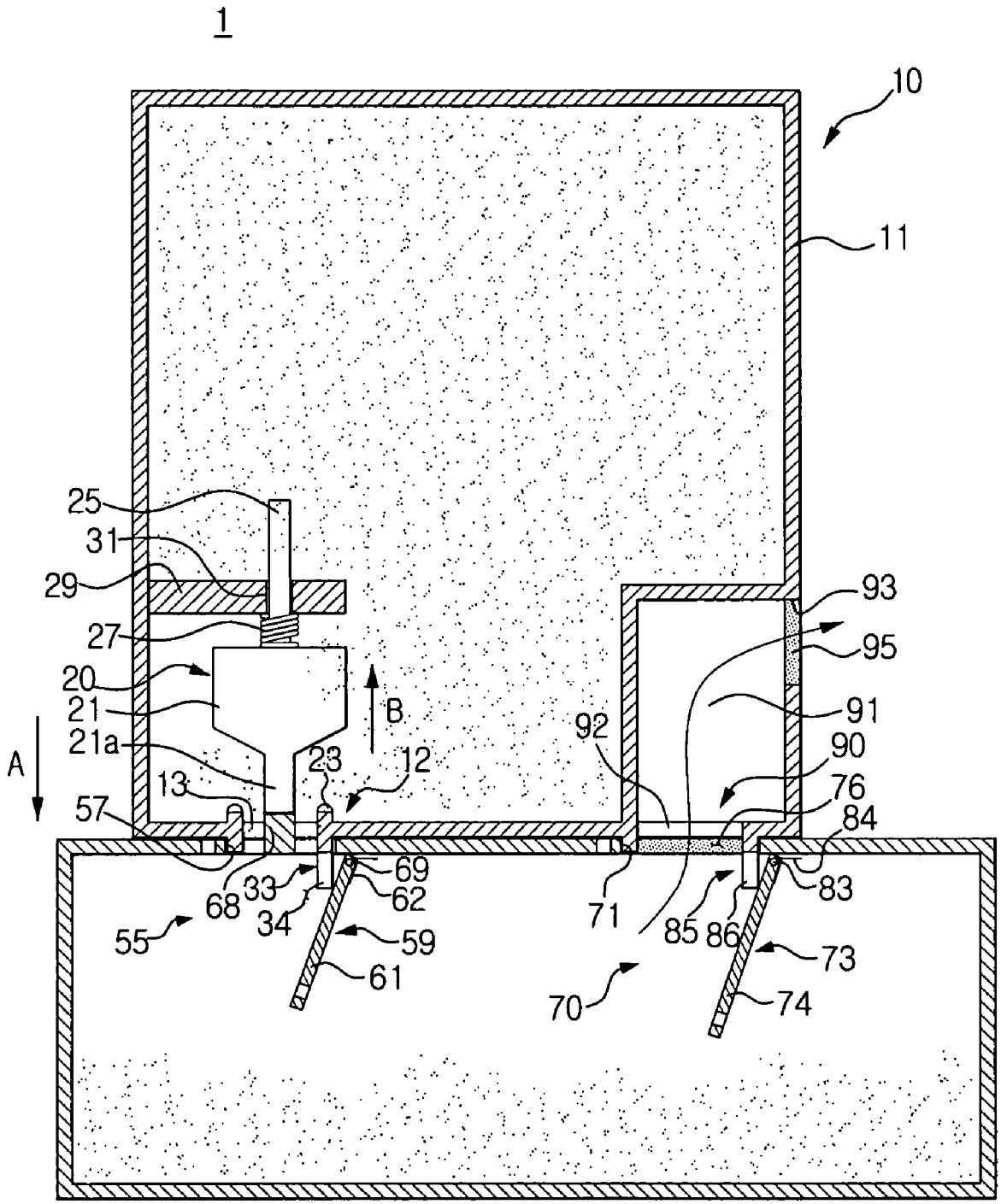
FIG. 2 is a diagram illustrating a developer filling operation of the developer filling system of FIG. 1.

FIGS. 1 and 2 show a developer filling system having a developer filling apparatus according to an embodiment of the present invention.

As shown in FIG. 1, the developer filling system 1 includes a developer supply unit 10 and a developer cartridge 50.

The developer supply unit 10 is utilized to fill the developer cartridge 50 with a developer in a powder form such as toner, and includes a developer supply container 11.

The developer supply container 11 contains the developer and compressed air having a predetermined pressure. The compressed air provides a discharging pressure and/or force for propelling the developer out of the developer supply container 11. Further, the developer supply container 11 has a developer discharge mechanism 12 disposed at one side of the bottom wall 11 a thereof.

The developer discharge mechanism 12 includes a developer outlet opening 13 that discharges the developer together with the compressed air, and a valve structure 20 that keeps the developer outlet opening 13 closed when an external force is not applied and that opens it when an external force is applied.

The valve structure 20 includes a first valve 21 having a first pressing protrusion 21*a* projecting through the developer outlet opening 13 to the outside of the developer supply container 11. The first valve 21 is placed on a first valve seat portion 23 formed at the developer outlet opening 13 within the developer supply container 11.

A first valve rod 25 is formed monolithically on the first valve 21. The first valve rod 25 is movably supported by a support hole 31 formed in a support bracket 29 of the developer supply container 11. A first spring 27 is installed at the first valve rod 25 to apply pressure to the first valve 21 towards the developer outlet opening 13.

The developer supply container 11 further includes a first shutter opener 33 that opens a first shutter 61 of a first open-close section 59 of the developer cartridge 50, to be described later. The first shutter opener 33 has a first shutter opening protrusion 34 projecting from the developer outlet opening 13 under the developer supply container 11 and facing the first shutter 61. In a developer filling operation, as shown in FIG. 2, the first shutter opening protrusion 34 ensures that the first shutter 61 is pushed (in the direction of an arrow A in FIG. 2) and is definitely opened when the developer supply container 11 is pushed towards the developer cartridge 50 when the developer outlet opening 13 is aligned with a developer inlet opening 57 of the developer cartridge 50.

The developer cartridge 50 is used to supply a developer to a development unit (not shown) of an image forming apparatus such as a copier or laser printer (not shown), and is installed in the development unit. T Aspects of the developer cartridge 50 relating to the supply of developer to a development unit during the operation of an image forming apparatus are known in the art, and a detailed description thereof is thus omitted.

The developer cartridge 50 has a developer inlet mechanism 55 at a site of the upper wall 51 thereof corresponding to the developer discharge mechanism 12. The developer inlet mechanism 55 includes the developer inlet opening 57 that inhales or takes in the developer and compressed air discharged through the developer outlet opening 13 of the developer supply container 11, and the first open-close section 59 that opens and closes the developer inlet opening 57.

The first open-close section 59 includes the first shutter 61 that opens and closes the developer inlet opening 57, and a first fastener 63 that locks the first shutter 61 in a closed state. The first shutter 61 has a first hinge axis 69 pivot-jointed to the upper wall 51 near to the developer inlet opening 57. The first shutter 61 is pressurized to a closed state by a first torsion spring 62. The first torsion spring 62 is placed at the first hinge axis 69. One end of the first torsion spring 62 is supported by the lower surface of the first shutter 61, and the other end is supported by the inside of the upper wall 51 of the developer cartridge 50. The first fastener 63 includes a first fixing screw 64that fixes the first shutter 61 to a first fixing hole 65 of the upper wall 51. The first fastener 63 acts to prevent leakage of the developer from the developer cartridge 50 due to inadvertent opening of the first shutter 61, and is loosened from the first fixing hole 65 and a second fixing hole 66 of the first shutter 61 in a developer filling operation.

An opening protrusion 68 is formed at the center of the developer inlet opening 57 so as to project above the upper wall 51 of the developer cartridge 50. As shown in FIG. 2, the opening protrusion 68 constitutes an opening section, which pushes up (in the direction of an arrow B in FIG. 2) the first pressing protrusion 21*a* of the first valve 21 to open the developer outlet opening 13 when in a developer filling operation, the developer supply container 11 is pushed towards the developer cartridge 50 in a state that the developer outlet opening 13 is aligned with a developer inlet opening 57 of the developer cartridge 50. However, it is to be understood that other valve mechanisms may be used to open a pathway between the developer supply container 11 and the developer cartridge 50.

The developer cartridge 50 further includes a first air discharge mechanism 70 that discharges the compressed air that enters from the developer supply container 11 when the developer cartridge 50 is filled with developer from the developer supply container 11. However, it is to be understood that the discharge mechanism 70 is not required in all aspects.

It is preferable, but not necessary, to dispose the first air discharge mechanism 70 as far as possible from the developer inlet opening 57 so that the first air discharge mechanism 70 is not directly affected by compressed air discharged through the developer outlet opening 13 into the developer cartridge 50.

The first air discharge mechanism 70 includes a first air discharge opening 71 that discharges the compressed air, a second open-close section 73 that opens and closes the first air discharge opening 71, and a first filter 76 that filters the developer contained in the compressed air discharged through the first air discharge opening 71.

The second open-close section 73 includes a second shutter 74 that opens and closes the first air discharge opening 71, and a second fastener 78 that locks the second shutter 74 in a closed state. The second shutter 74 has a second hinge axis 83 pivot-jointed to the upper wall 51 near to the first air discharge opening 71. The second shutter 74 is pressurized to a closed state by a second torsion spring 84. The second torsion spring 84 is placed at the second hinge axis 83. One end of the second torsion spring 84 is supported by the lower surface of the second shutter 74, and the other end is supported by the inside of the upper wall 51 of the developer cartridge 50. The second fastener 78 includes a second fixing screw 79 that fixes the second shutter 74 to a third fixing hole 81 of the upper wall 51. The second fastener 78 acts to prevent leakage of the developer from the developer cartridge 50 due to inadvertent opening of the second shutter 74, and is loosened from the third fixing hole 81 and a fourth fixing hole 82 of the second shutter 74 in a developer filling operation.

The first filter 76 is made of a material such as sponge capable of filtering a developer such as toner in a powder form.

A second shutter opener 85 is provided under the bottom wall 11 a of the developer supply container 11 to open the second shutter 74, thereby discharging compressed air through the first air discharge opening 71 when, in a developer filling operation, the developer supply container 11 is pushed towards the developer cartridge 50 in a state wherein the developer outlet opening 13 is aligned with a developer inlet opening 57 of the developer cartridge 50. The second shutter opener 85 has a second shutter opening protrusion 86 projecting from the bottom wall 11 a and facing the second shutter 74.

A second air discharge mechanism 90 is arranged at the developer supply container 11 near to the second shutter opener 85 to guide and externally discharge the compressed air coming through the first air discharge opening 71 of the first air discharge mechanism 70. The second air discharge mechanism 90 comprises an air passage 91 and a second filter 95. The second air discharge mechanism 90 is completely external to the developer supply container 11, and compressed air discharged into the second air discharge mechanism 90 does not mix or communicate in any way with developer and compressed air contained in the developer supply container 11 according to an aspect of the invention.

The air passage 91 includes a first air inlet opening 92 formed to face the first air discharge opening 71, and a second air discharge opening 93 leading to an exterior outlet. For example, compressed air from the second air discharge mechanism 90 may be discharged to any area outside of the developer supply container 11 or may be vented to the outside. The second filter 95 is installed at the second air discharge opening 93, and adapted to filter the developer contained in the discharged compressed air to externally discharge the compressed air without discharging any of the developer. The second filter 95 is made of a porous material, such as, for example, a sponge material, that is capable of allowing air to pass through and blocking the passage of toner. However, it is to be understood that the air passage 91 is not required in all aspects of the invention.

Hereinafter, referring to FIGS. 1 and 2, a detailed description will be given of a developer filling operation of the developer filling system 1 having the above-described configuration.

First, the developer supply container 11 containing a developer and compressed air and the developer cartridge 50 are prepared.

In the developer cartridge 50, the first fixing screw 64 of the first fastener 63 is loosened and removed from the first fixing hole 65 and second fixing hole 66, and the second fixing screw 79 of the second fastener 78 is loosened and removed from the third fixing hole 81 and fourth fixing hole 82.

The developer supply container 11 is shaken to appropriately mix the developer and compressed air contained therein. As shown in FIG. 1, the developer supply container 11 is then moved above the developer cartridge 50 such that the developer outlet opening 13 and the first air inlet opening 92 are aligned with the developer inlet opening 57 and the first air discharge opening 71, respectively, of the developer cartridge 50.

Then, the developer supply container 11 is pushed down towards the developer cartridge 50. As a result, as shown in FIG. 2, the opening protrusion 68 of the developer cartridge 50 pushes up the first pressing protrusion 21*a* of the first valve 21 against an elastic force of the first spring 27. Consequently, the first valve 21 is detached from the first valve seat portion 23 while the first valve rod 25 is guided through the support hole 31 of the support bracket 29, thereby opening the developer outlet opening 13.

At the same time, the first shutter opening protrusion 34 of the first shutter opener 33 pushes down the first shutter 61 against an elastic force of the first torsion spring 62, and the first shutter 61 pivots on the first hinge axis 69 and descends, thereby opening the developer inlet opening 57. In the same manner, the second shutter opening protrusion 86 of the second shutter opener 85 pushes down the second shutter 74 against an elastic force of the second torsion spring 84, and the second shutter 74 pivots on the second hinge axis 83 and descends, thereby opening the first air discharge opening 71.

It is to be understood that in coupling the developer supply container 11 and the developer cartridge 50 into the position shown in FIG. 2, the developer supply container 11 may be moved into the position shown in FIG. 2 while the developer cartridge 50 remains stationary or the developer supply container 11 may be held stationary while the developer cartridge is moved into position shown in FIG. 2, or both the developer supply container and the developer cartridge 50 may be moved.

The developer in the developer supply container 11 together with the compressed air is exhausted or discharged through the developer outlet opening 13 and inhaled or taken in through the developer inlet opening 57 into the developer cartridge 50 owing to the pressure of the compressed air.

As the developer and the compressed air in the developer supply container 11 are continuously taken into the developer cartridge 50, the compressed air in the developer cartridge 50 moves through the first air discharge opening 71 and first air inlet opening 92 to the air passage 91, and is discharged out through the second air discharge opening 93, owing to the internal pressure. At this time, the developer contained in the compressed air is filtered out by the first filter 76 placed at the air discharge opening 71 and by the second filter 95 placed at the second air discharge opening 93.

Afterwards, if the developer and compressed air in the developer supply container 11 are completely discharged or if the developer is not further taken into the developer cartridge 50 because the developer cartridge 50 is fully filled with the developer, the developer supply container 11 is raised up while a downward pressing force is removed, and thus is detached from the developer cartridge 50. While not required in all aspects, when the cartridge 50 is filled, the filter 95 and/or filter 76 can be closed to prevent exhausting the compressed air from the cartridge 11 prematurely.

As a result, the opening protrusion 68 of the developer cartridge 50 is detached from the first pressing protrusion 21 a of the first valve 21. Consequently, while the first valve rod 25 is guided through the support hole 31 of the support bracket 29 owing to the first spring 27, the first valve 21 restores an original state and sits on the first valve seat portion 23, thereby closing the developer outlet opening 13.

At the same time, the first shutter opening protrusion 34 of the first shutter opener 33 is detached from the first shutter 61, and the second shutter opening protrusion 86 of the second shutter opener 85 is detached from the second shutter 74. Consequently, owing to the elastic force of the first torsion spring 62, the first shutter 61 pivots on the first hinge axis 69 and ascends, thereby closing the developer inlet opening 57. Owing to the elastic force of the second torsion spring 84, the second shutter 74 pivots on the second hinge axis 83 and ascends, thereby closing the first air discharge opening 71.

It is to be understood that in detaching the developer supply container 11 from the developer cartridge 50 into the position shown in FIG. 2, the developer supply container 11 may be detached while the developer cartridge 50 remains stationary or the developer supply container 11 may be held stationary while the developer cartridge is detached, or both the developer supply container and the developer cartridge 50 may be moved apart.

Finally, the first fixing screw 64 of the first fastener 63 is fixed to the first fixing hole 65 and second fixing hole 66 to prevent inadvertent opening of the first shutter 61, and the second fixing screw 79 of the second fastener 78 is fixed to the third fixing hole 81 and fourth fixing hole 82 to prevent inadvertent opening of the second shutter 74. With this, the developer filling operation finishes.

While shown in an embodiment in which the compressed air provides a pressure differential sufficient to exhaust the developer into the cartridge 50, it is to be understood that the pressure differential can be otherwise created. For example, a pressure differential could be created by providing a vacuum or partial vacuum in the cartridge 50.

Figure 3:
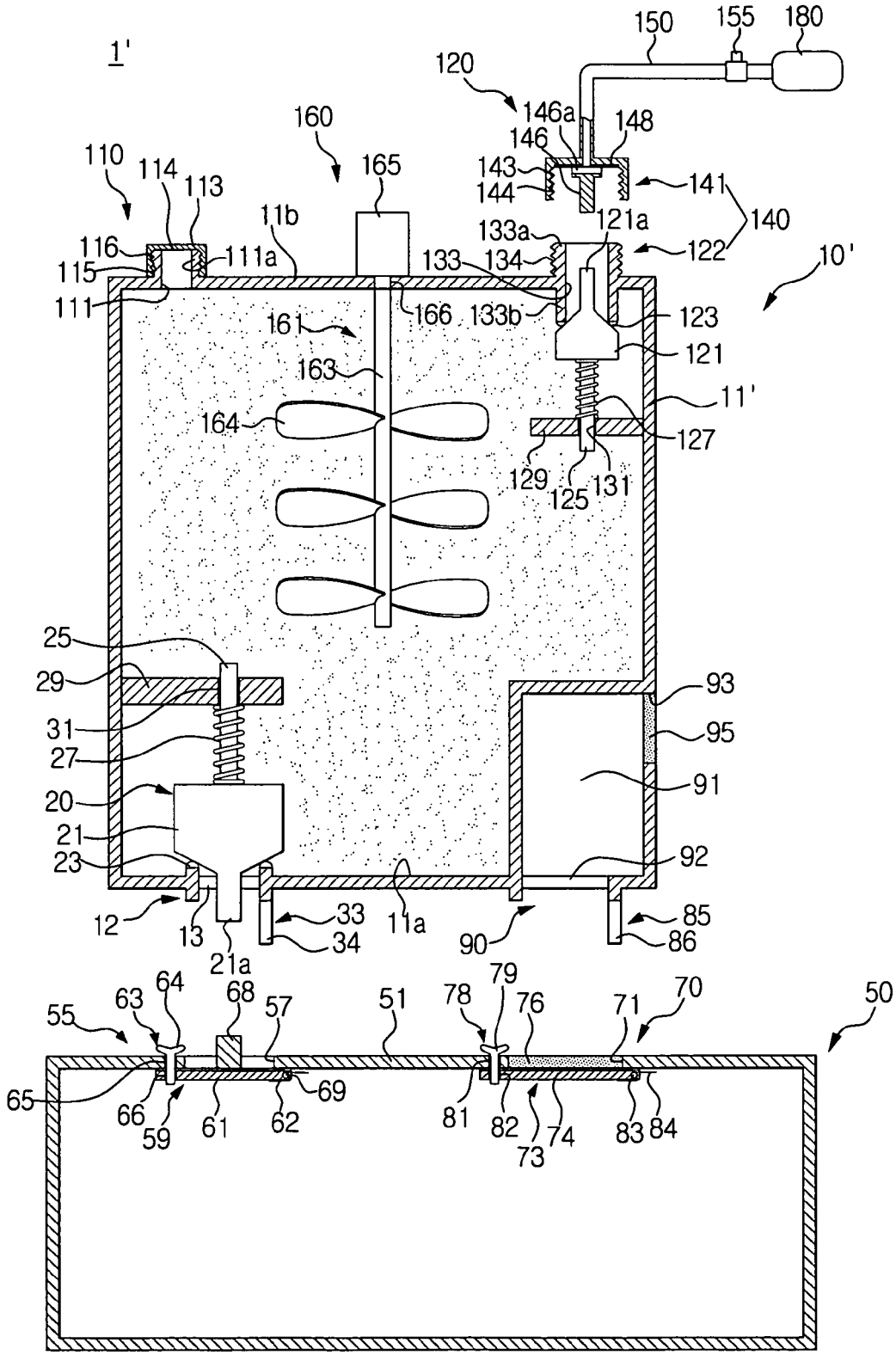
FIG. 3 is a diagram showing a developer filling system having additional features according to an embodiment of the invention.
Figure 4:
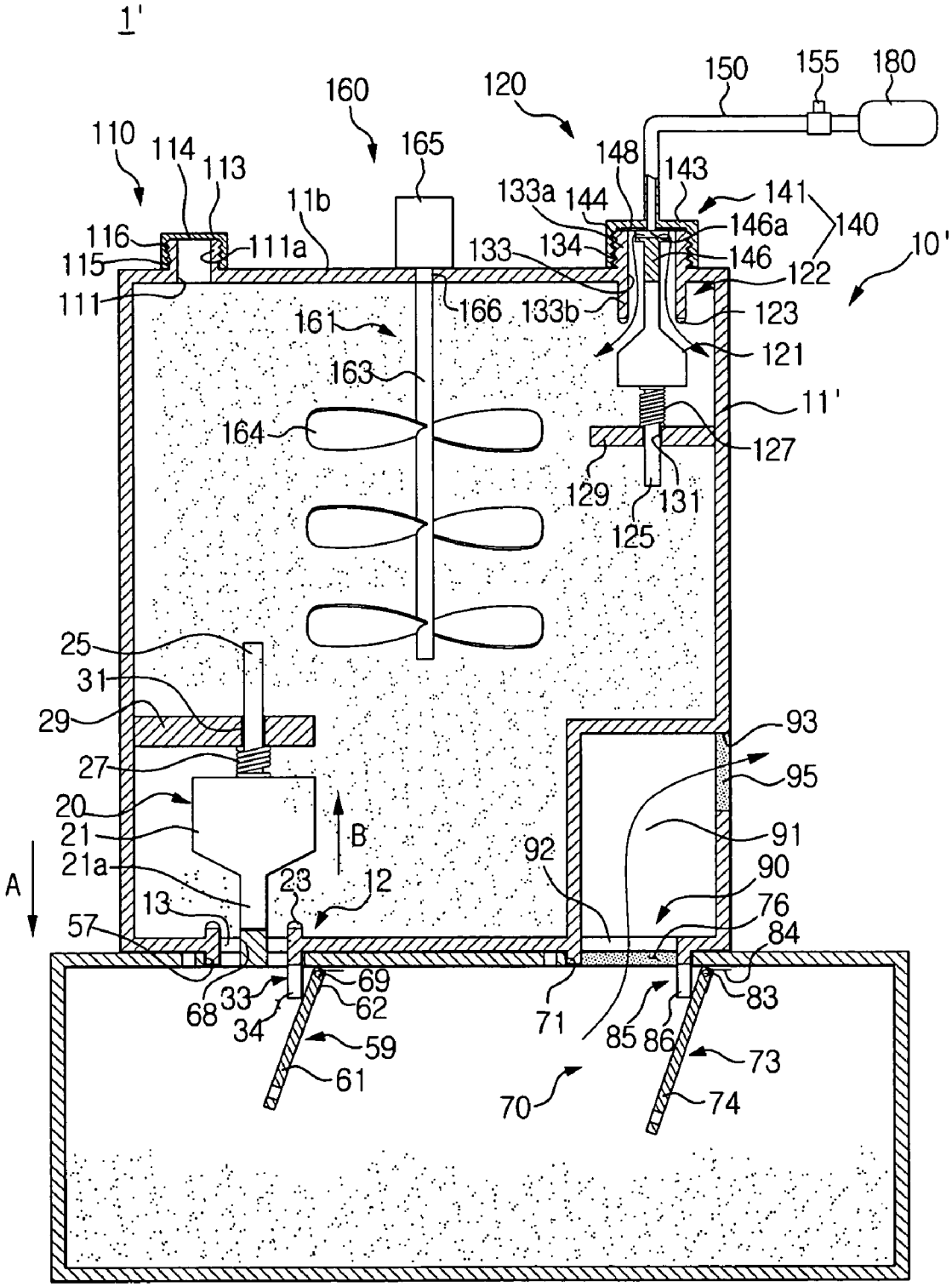
FIG. 4 is a diagram illustrating a developer filling operation of the developer filling system of FIG. 3.

FIGS. 3 and 4 show a developer filling system in which the developer filling apparatus has additional features.

As shown in FIG. 3, the developer filling system 1' for an image forming apparatus comprises a developer supply unit 10' and a developer cartridge 50.

The developer cartridge 50 has the same configuration and function as those of the corresponding developer cartridge described with reference to FIGS. 1 and 2, and a detailed description of the developer cartridge 50 is not repeated.

The developer supply unit 10' acts to fill the developer cartridge 50 with a developer in a powder form, such as, for example, toner, and comprises a developer supply container 11', a developer supply mechanism 110, a compressed air supply mechanism 120, and an agitating mechanism 160.

The developer supply container 11' contains the developer and compressed air having a predetermined pressure. The compressed air provides a discharging force for propelling the developer out of the developer supply container 11'. The developer supply container 11' comprises a developer discharge mechanism 12 and a second air discharge mechanism 90. The developer discharge mechanism 12 and second air discharge mechanism 90 have the same configurations and functions as those of the corresponding ones in the developer supply container 11 described with reference to FIGS. 1 and 2. Therefore, a detailed description of the developer discharge mechanism 12 and the second air discharge mechanism 90 is not repeated.

A developer supply mechanism 110 is utilized to supply the developer to the developer supply container 11', and includes a developer supply opening 111 formed at the upper wall 11*b* of the developer supply container 11' and a sealing cap 113 helically coupled to the developer supply opening 111 to tightly seal the developer supply opening 111. A tight seal 114 is provided in the sealing cap 113 to tightly seal the gap between the upper end 111*a* of the developer supply opening 111 and the sealing cap 113.

When the developer is exhausted in the developer supply container 11', the sealing cap 113 is removed from the developer supply opening 111 and a fresh developer is supplied through the developer supply opening 111 to the developer supply container 11'.

The compressed air supply mechanism 120 is used to supply the compressed air to the developer supply container 11', and includes a compressed air supplier 180 and a connection pipe 150.

The compressed air supplier 180 may be a conventional compressed air tank or generator for storing or generating compressed air that is used to discharge the developer in the developer supply container 11' through the developer discharge mechanism 12 thereof. The compressed air is supplied to the developer supply container 11' during or prior to a developer filling operation.

The connection pipe 150 is connected to the compressed air supplier 180 and includes a conventional shutoff valve 155 for permitting or cutting off supply of the compressed air. The connection pipe 150 is monolithically or detachably connectable to the developer supply container 11' and may be flexible or rigid.

A connection fitting 140 is shown installed between the connection pipe 150 and the developer supply container 11' to detachably interconnect the connection pipe 150 and the developer supply container 11'. The connection fitting 140 includes a male part 122 formed at the upper wall 11*b* of the developer supply container 11' and a female part 141 formed at an end of the connection pipe 150. Alternatively, the male part 122 and female part 141 may be reversed. Moreover, the fitting need not be used in all aspects.

The male part 122 includes a second air inlet opening 133 projecting upwards from the upper wall 11*b* of the developer supply container 11'. A male-thread 134 is formed on the periphery surface of the upper portion 133*a* of the second air inlet opening 133 projecting upwards from the upper wall 11*b* of the developer supply container 11'. A second valve seat portion 123 is formed at the lower portion 133*b* of the second air inlet opening 133 disposed in the developer supply container 11'. A second valve 121 sits on the second valve seat portion 123, and includes a second pressing protrusion 121*a* projecting through the second air inlet opening 133 towards the outside of the developer supply container 11'. A second valve rod 125 is connected to the second valve 121 and movably supported by a second support hole 131 of a second support bracket 129 of the developer supply container 11'. A second spring 127 is installed at the second valve rod 125, and is adapted to push the second valve 121 towards the second air inlet opening 133.

The female part 141 includes a cylindrical portion 143 connected to the end of connection pipe 150. A female thread 144, to be coupled to the male-thread 134 formed at the upper portion 133*a* of the second air inlet opening 133, is formed on the inner periphery of the cylindrical portion 143. A second opening protrusion 146 is arranged in the cylindrical portion 143, and adapted to push the second valve 121 and open the second air inlet opening 133 when the cylindrical portion 143 is helically coupled to the upper portion 133*a* of the second air inlet opening 133. The second opening protrusion 146 has an air flowing passage 146*a* therein for connecting the connection pipe 150 to the inner space of the cylindrical portion 143. A seal ring 148 is arranged at a contacting surface between the upper portion 133*a* of the second air inlet opening 133 and the cylindrical portion 143. It is to be understood that other seals can be used and/or that the male and female portions can be otherwise disposed.

A description will be given of a connection operation of the connection fitting 140 having the above-described configuration.

First, in a state shown in FIG. 3, the cylindrical portion 143 connected to the end of the connection pipe 150 is moved downwards and helically coupled to the upper portion 133*a* of the second air inlet opening 133.

In the helical coupling of the cylindrical portion 143 to the upper portion 133*a* of the second air inlet opening 133, the cylindrical portion 143 is slowly moved downwards, and the second opening protrusion 146 arranged in the cylindrical portion 143 thus pushes the second pressing protrusion 121*a* of the second valve 121 against an elastic force of the second spring 127 to detach the second valve 121 from the second valve seat portion 123. Consequently, the second valve 121 is moved downwards, opening the second air inlet opening 133. Compressed air can be supplied from the compressed air supplier 180 through the connection pipe 150, the air flowing passage 146*a* of the second opening protrusion 146 and the second air inlet opening 133 to the developer supply container 11'.

Now, a detachment operation of the connection fitting 140 is described.

In a state shown in FIG. 4, the cylindrical portion 143 is rotated and decoupled from the upper portion 133*a* of the second air inlet opening 133, and the connection pipe 150 become disconnected from the developer supply container 11'. Consequently, the second opening protrusion 146 is detached from the second pressing protrusion 121*a* of the second valve 121, and the second valve 121 restores an original state owing to the elastic force of the second spring 127 and sits on the second valve seat portion 123, thereby closing the second air inlet opening 133.

The agitating mechanism 160 serves to agitate the developer in the developer supply container 11', and comprises an agitation impeller 161 for agitating the developer in the developer supply container 11' and a drive motor 165 for rotating the agitation impeller 161. The agitation impeller 161 includes an agitation shaft 163 rotatably installed at the center of the upper wall 11*b* of the developer supply container 11 ' and one or more blades 164 formed at the agitation shaft 163. The drive motor 165 is arranged on the upper wall 11*b* of the developer supply container 11', and includes a drive shaft 166 coaxially connected to the agitation shaft 163. The drive motor 165 drives the agitation shaft 163 of the agitation impeller 161 to agitate the developer within the developer supply container 11' in a developer filling operation. However, it is to be understood that the agitating mechanism 160 need not be used in all aspects of the invention and can be used in the embodiment shown in FIG. 1

In the above description of the developer filling system 1', it is illustrated that the compressed air is supplied during a developer filling operation. However, the present invention is not limited to this. For example, prior to a developer filling operation, after the developer is supplied through the developer supply mechanism 110 to the developer supply container 11', the compressed air may be supplied through the compressed air supply mechanism 120 to the developer supply container 11' until the pressure in the developer supply container 11' rises to a predetermined pressure high enough for the developer filling operation. In other words, the developer supply container 11' may be filled with compressed air and kept in that state prior to a developer filling operation.

The developer filling operation of the developer filling system 1' having the above-described configuration is performed in the same manner as the case of the developer filling system 1, described with reference to FIGS. 1 and 2, except that, during the developer filling operation, the developer in the developer supply container 11' is agitated with the agitation impeller 161 driven by the drive motor 165 and the compressed air is supplied through the compressed air supply mechanism 120 to the developer supply container 11'. A detailed description of the developer filling operation of the developer filling system 1' is thus omitted.

As is apparent from the above description, aspects of the present invention provide a developer filling apparatus and a developer filling system having the same wherein a developer cartridge can be easily filled with a developer using the force of compressed air in a developer filling operation. Accordingly, the developer filling operation can be performed more easily in comparison to a conventional manual operation utilizing a developer measuring container. In addition, the developer is prevented from being blown around during a developer filling operation, thereby improving working conditions and avoiding environmental pollution.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developer filling apparatus comprising a developer supply container that contains a developer and compressed air;

a developer discharge mechanism including a developer outlet opening that discharges the developer and compressed air from the developer supply container; and a valve structure disposed at the developer outlet opening that keeps the developer outlet opening in a closed position absent an external force and that opens the developer outlet opening upon application of an external force, wherein the developer supply container further comprises a first shutter opener that opens a first shutter disposed at a developer inlet opening of a developer cartridge, the first shutter serving to open and close the developer inlet opening.

2. The developer filling apparatus of claim 1, wherein the valve structure comprises:

a first valve placed on a first valve seat portion formed at the developer outlet opening in the developer supply container, the first valve having a first pressing protrusion projecting through the developer outlet opening to the outside of the developer supply container;

a first valve rod connected with the first valve and movably installed in the developer supply container; and a first spring installed at the first valve rod, the first spring biasing the first valve towards the developer outlet opening.

3. The developer filling apparatus of claim 1, wherein the first shutter opener comprises a first shutter opening protrusion projecting from the developer outlet opening so as to face the first shutter, the first shutter opening protrusion opening the first shutter.

4. The developer filling apparatus of claim 1, wherein the developer supply container further comprises a second shutter opener that opens a second shutter, the second shutter opening and closing a first air discharge opening of the developer cartridge.

5. The developer filling apparatus of claim 4, wherein the second shutter opener comprises a second shutter opening protrusion projecting so as to face the second shutter, the second shutter opening protrusion opening the second shutter.

6. The developer filling apparatus of claim 4, wherein the developer supply container further comprises an air discharge mechanism that guides and externally discharges the compressed air that has passed through the first air discharge opening of the developer cartridge.

7. The developer filling apparatus of claim 6, wherein the air discharge mechanism comprises:

an air passage including an air inlet opening adapted to face the first air discharge opening and a second air discharge opening adapted to lead to an exterior outlet, the air passage guiding the compressed air inhaled through the air inlet opening; and a filter for filtering developer contained in the compressed air inhaled to the air passage.

8. A developer filling apparatus comprising a developer supply container that contains a developer and compressed air:

a developer discharge mechanism including a developer outlet opening that discharges the developer and compressed air from the developer supply container;

a valve structure disposed at the developer outlet opening that keeps the developer outlet opening in a closed position absent an external force and that opens the developer outlet opening upon application of an external force;

a developer supply mechanism that supplies the developer to the developer supply container;

compressed air supply mechanism that supplies the compressed air to the developer supply container; and an agitating mechanism that agitates the developer in the developer supply container.

9. The developer filling apparatus of claim 8, wherein the developer supply mechanism comprises:

a developer supply opening formed at the developer supply container; and a sealing cap that tightly seals the developer supply opening.

10. The developer filling apparatus of claim 8, wherein the compressed air supply mechanism comprises:

a compressed air supplier that stores or generates the compressed air; and a connection pipe that interconnects the compressed air supplier and the developer supply container.

11. The developer filling apparatus of claim 10, wherein the compressed air supply mechanism further comprises a connection fitting that detachably interconnects the connection pipe and the developer supply container.

12. The developer filling apparatus of claim 8, wherein the agitating mechanism comprises:

an agitation impeller installed in the middle of the developer supply container, the agitation impeller agitating the developer in the developer supply container; and a drive motor coupled to a shaft of the agitation impeller, the drive motor rotating the shaft of the agitation impeller.

13. A developer filling system comprising:

a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position absent an external force and that opens the developer outlet opening upon application of an external force; and a developer cartridge that supplies the developer to a development unit of an image forming apparatus, the developer cartridge comprising a developer inlet mechanism, the developer inlet mechanism including a developer inlet opening that takes in the developer and compressed air discharged through the developer outlet opening, a first open-close section that opens and closes the developer inlet opening, and an opening section disposed at the developer inlet opening developer inlet opening to open the developer outlet opening by applying the force to the valve structure.

14. The developer filling system of claim 13, wherein the valve structure comprises:

a first valve placed on a first valve seat portion formed at the developer outlet opening in the developer supply container, the first valve having a first pressing protrusion projecting through the developer outlet opening to the outside of the developer supply container;

a first valve rod connected with the first valve and movably installed in the developer supply container; and a first spring installed at the first valve rod, the first spring pushing the first valve towards the developer outlet opening.

15. The developer filling system of claim 13, wherein the first open-close section comprises:

a first shutter that elastically opens and closes the developer inlet opening; and a first fastener that locks the first shutter in a closed state.

16. The developer filling system of claim 15, wherein the first fastener comprises a first fixing screw that fixes the first shutter to the developer cartridge.

17. The developer filling system of claim 15, wherein the developer supply container further comprises a first shutter opener that opens the first shutter.

18. The developer filling system of claim 17, wherein the first shutter opener comprises a first shutter opening protrusion projecting from the developer outlet opening so as to face the first shutter, the first shutter opening protrusion opening the first shutter.

19. The developer filling system of claim 13, wherein the developer cartridge further comprises a first air discharge mechanism that discharges compressed air taken into the developer cartridge.

20. The developer filling system of claim 19, wherein the first air discharge mechanism comprises:

a first air discharge opening that discharges compressed air taken into the developer cartridge;

a second open-close section that opens and closes the first air discharge opening; and a first filter arranged at the first air discharge opening, the first filter filtering the developer contained in the compressed air discharged through the first air discharge opening.

21. The developer filling system of claim 20, wherein the second open-close section comprises:

a second shutter that elastically opens and closes the first air discharge opening; and a second fastener that locks the second shutter in a closed state.

22. The developer filling system of claim 21, wherein the second fastener comprises a second fixing screw that fixes the second shutter to the developer cartridge.

23. The developer filling system of claim 21, wherein the developer supply container further comprises a second shutter opener that opens the second shutter.

24. The developer filling system of claim 23, wherein the second shutter opener comprises a second shutter opening protrusion projecting so as to face the second shutter, the second shutter opening protrusion opening the second shutter.

25. The developer filling system of claim 20, wherein the developer supply container further comprises a second air discharge mechanism that guides and externally discharges the compressed air coming through the first air discharge opening.

26. The developer filling system of claim 25, wherein the second air discharge mechanism comprises:

an air passage including a first inlet opening adapted to face the first air discharge opening and a second air discharge opening adapted to lead to an exterior outlet, the air passage guiding the compressed air inhaled through the first air inlet opening; and a second filter that filters the developer contained in the compressed air inhaled to the air passage.

27. The developer filling system of claim 13, further comprising:

a developer supply mechanism that supplies the developer to the developer supply container;

a compressed air supply mechanism that supplies the compressed air to the developer supply container; and an agitating mechanism that agitates the developer in the developer supply container.

28. The developer filling system of claim 27, wherein the developer supply mechanism comprises:

a developer supply opening formed at the developer supply container; and a sealing cap that tightly seals the developer supply opening.

29. The developer filling system of claim 27, wherein the compressed air supply mechanism comprises:

a compressed air supplier that stores or generates the compressed air; and a connection pipe that interconnects the compressed air supplier and the developer supply container.

30. The developer filling system of claim 29, wherein the compressed air supply mechanism further comprises a connection fitting that detachably interconnects the connection pipe and the developer supply container.

31. The developer filling system of claim 27, wherein the agitating mechanism comprises:

an agitation impeller installed in the middle of the developer supply container, the agitation impeller agitating the developer in the developer supply container; and a drive motor coupled to a shaft of the agitation impeller, the drive motor rotating the shaft of the agitation impeller.

32. A developer filling system comprising:

a developer supply container that contains a developer, the developer supply container comprising a developer discharge mechanism that includes a developer outlet opening that discharges the developer from the developer supply container; and a developer cartridge that supplies the developer to a development unit of an image forming apparatus, the developer cartridge comprising a developer inlet mechanism that includes a includes a developer inlet opening that takes in the developer discharged through the developer outlet opening of the developer supply container, and wherein:

the developer is discharged from the developer supply container and taken into the developer cartridge according to a pressure differential between the developer supply container and the developer cartridge, and the pressure differential between the developer supply container and the developer cartridge is provided by a partial vacuum in the developer cartridge.

33. The developer filling system of claim 32, wherein the developer supply container contains compressed air that creates the pressure differential between the developer supply container and the developer cartridge.

34. The developer filling system of claim 32, wherein the developer discharge mechanism of the developer supply container includes a valve structure disposed at the developer outlet opening that keeps the developer outlet opening in a closed position absent an external force and that opens the developer outlet opening upon application of an external force, and wherein the developer inlet mechanism of the developer cartridge includes a first open-close section that opens and closes the developer inlet opening, and an opening section disposed at the developer inlet opening of the developer cartridge to open the developer outlet opening of the developer supply container by applying the force to the valve structure.

35. A refillable developer cartridge that supplies a developer to a development unit of an image forming apparatus, the developer cartridge comprising a developer inlet mechanism, the developer inlet mechanism including a developer inlet opening that takes in developer and compressed air discharged through a developer outlet opening of a developer supply container, a first open-close section that opens and closes the developer inlet opening, and an opening section disposed at the developer inlet opening to open the developer outlet opening of a developer supply container by applying the force to a valve structure of the developer supply container; and an air discharge mechanism that discharges compressed air taken into the developer cartridge, the air discharge mechanism comprising an air discharge opening that discharges compressed air taken into the developer cartridge, a second open-close section that opens and closes the air discharge opening, and a filter arranged at the air discharge opening, the filter filtering any developer contained in the compressed air discharged through the air discharge opening.

36. A refillable developer cartridge that supplies a developer to a development unit of an image forming apparatus, the developer cartridge comprising a developer inlet mechanism, the developer inlet mechanism including a developer inlet opening that takes in developer and compressed air, a first open-close section that opens and closes the developer inlet opening; and an air discharge mechanism that discharges compressed air taken into the developer cartridge, the air discharge mechanism comprising an air discharge opening that discharges compressed air taken into the developer cartridge, a second open-close section that opens and closes the air discharge opening, and a filter arranged at the air discharge opening, the filter filtering any developer contained in the compressed air discharged through the air discharge opening, wherein the developer cartridge interfaces with a developer filling apparatus comprising a developer supply container that contains a developer and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position absent an external force and that opens the developer outlet opening upon application of an external force, and wherein the first open-close section that opens and closes the developer inlet opening is opened by a first shutter opening protrusion of the developer supply container, the second open-close section that opens and closes the air discharge opening is opened by a second shutter opening protrusion of the developer supply container, and the developer inlet mechanism includes opening protrusion extending from the developer inlet opening that opens the developer outlet opening of the developer supply container by applying applying the force to the valve structure of the developer supply container.

37. A method of refilling a developer cartridge comprising:

engaging (a) the developer cartridge, wherein the developer cartridge comprises a developer inlet mechanism that includes a closeable developer inlet opening that takes in developer into a chamber having a first pressure, with (b) a developer filling apparatus comprising a developer supply container that contains a developer stored at a second pressure greater than the first pressure and comprises a developer discharge mechanism that includes a developer outlet opening that discharges the developer into the chamber of the developer cartridge through a valve structure that opens the developer outlet opening upon application of an external force when the developer filling apparatus is engaged with the developer cartridge; and filling the chamber of the developer cartridge with developer through the opened developer outlet opening of the developer supply chamber and the developer inlet opening according to a pressure differential between first and second pressures.

38. The method of claim 37, wherein the developer cartridge includes a first shutter that is opened by a first shutter opening protrusion of the developer supply container;

the developer inlet mechanism of the developer cartridge includes an opening protrusion extending from the developer inlet opening that opens the developer outlet opening of the developer supply container by applying the force to the valve structure of the developer supply container.

39. A method of refilling a developer cartridge comprising:

engaging (a) the developer cartridge, wherein the developer cartridge comprises a developer inlet mechanism that includes a developer inlet opening that takes in developer and compressed air, a first shutter that opens and closes the developer inlet opening; and an air discharge mechanism that discharges compressed air taken into the developer cartridge, the air discharge mechanism comprising an air discharge opening that discharges compressed air taken into the developer cartridge, a second shutter that opens and closes the air discharge opening, and a filter arranged at the air discharge opening, the filter filtering any developer contained in the compressed air discharged through the air discharge opening, with (b) a developer filling apparatus comprising a developer supply container that contains a developer and compressed air, the and compressed air, the developer supply container comprising a developer discharge mechanism, the developer discharge mechanism including a developer outlet opening that discharges the developer and compressed air, and a valve structure disposed at the developer outlet opening that keeps the developer outlet opening in a closed position absent an external force and that opens the developer outlet opening upon application of an external force, wherein the first shutter of the developer cartridge is opened by a first shutter opening protrusion of the developer supply container, wherein the developer inlet mechanism of the developer cartridge includes an opening protrusion extending from the developer inlet opening that opens the developer outlet opening of the developer supply container by applying the force to the valve structure of the developer supply container so that developer and compressed air enter the developer inlet opening of the developer cartridge, and wherein the second shutter of the developer cartridge is opened by a second shutter opening protrusion of the developer supply container, so that compressed air is discharged through the air discharge opening.

40. The method of claim 39, further comprising disengaging the developer cartridge from the developer filling apparatus when the developer cartridge has been filled with developer.

41. The method of claim 40 wherein the first shutter of the developer cartridge is fastened by a first fastener and the second shutter of the developer cartridge is fastened by a second fastener, the method further comprising removing the first and second fastener before engaging the developer cartridge with the developer filling apparatus and replacing the first fastener and second fastener after disengaging the developer cartridge from the developer filling apparatus.

42. The method of claim 39, further comprising agitating the developer and compressed air contained in the developer supply container.

43. The method of claim 41, further comprising agitating the developer and compressed air contained in the developer supply container while the developer cartridge is engaged with the developer filling apparatus.

44. The method of claim 39 further comprising supplying the developer supply container with compressed air.

45. The method of claim 44, wherein the developer supply container is supplied with compressed air while the developer cartridge is engaged with the developer filling apparatus.

46. The method of claim 45, further comprising shaking the developer supply container before the developer cartridge is engaged with the developer filling apparatus.

47. The method of claim 39 wherein the developer cartridge is engaged with the developer filling apparatus by aligning the developer outlet opening of the developer supply container with the developer inlet opening of the developer cartridge, aligning the air discharge opening of the developer cartridge with an air inlet opening of the developer filling apparatus and then bringing the developer filling apparatus and the developer cartridge together.

* * * * *

UNITED STATES PATENT AND TRADEMARK OFFICE

CERTIFICATE OF CORRECTION

PATENT NO. : 7,574,160 B2
APPLICATION NO. : 11/475100
DATED : August 11, 2009
INVENTOR(S) : Soo-yong Jung et al.

It is certified that error appears in the above-identified patent and that said Letters Patent is hereby corrected as shown below:

Column 14, line 52, claim 8 change "air:" to --air;--
Column 14, line 63, claim 8 insert --a-- before "compressed"

Column 20, line 29, claim 43 change "claim 39" to --claim 39,--
Column 20, line 37, claim 47 change "claim 39" to --claim 39,--

Signed and Sealed this

Twenty-second Day of December, 2009

David J. Kappos

David J. Kappos
*Director of the United States Patent and Trademark Office*